US006517356B1

(12) United States Patent
Smith

(10) Patent No.: US 6,517,356 B1
(45) Date of Patent: Feb. 11, 2003

(54) SWIVEL ADAPTOR FOR USE WITH INLET PIPE

(76) Inventor: Philip E. Smith, 3732 Electro Way, Redding, CA (US) 96002

( * ) Notice: Subject to any disclaimer, the term of this patent is extended or adjusted under 35 U.S.C. 154(b) by 0 days.

(21) Appl. No.: 09/973,502

(22) Filed: Oct. 9, 2001

(51) Int. Cl.[7] ..... H01R 39/00
(52) U.S. Cl. ..... 439/17; 285/276
(58) Field of Search ..... 439/11, 13, 17, 439/18, 19; 285/276, 279

(56) References Cited

U.S. PATENT DOCUMENTS 2,396,123 A * 3/1946 Phillips ..... 439/13
2,452,168 A * 10/1948 Warren ..... 439/18
3,701,072 A * 10/1972 Bjorn et al. ..... 439/17
5,538,296 A * 7/1996 Horton ..... 285/276
5,664,951 A 9/1997 Clary et al.
6,053,539 A * 4/2000 Bravo ..... 285/276
6,217,083 B1 * 4/2001 Bravo ..... 285/276

* cited by examiner

*Primary Examiner*—Gary Paumen
*Assistant Examiner*—Felix O. Figueroa
(74) *Attorney, Agent, or Firm*—Thomas R. Lampe

(57) ABSTRACT

A swivel adaptor for connection to an inlet pipe leading to a storage tank includes two swivel adaptor members, one of which is rotatably mounted on the other. A plurality of electrically conductive ball bearings are positioned in the channel formed by the swivel adaptor members. The ball bearings facilitate rotation, prevent separation of the swivel adaptor members and provide an electrical interconnection between the swivel adaptor members.

2 Claims, 3 Drawing Sheets

SWIVEL ADAPTOR FOR USE WITH INLET PIPE

TECHNICAL FIELD

This invention relates to a swivel adaptor employed in association with an inlet pipe leading to a storage tank. The adaptor has particular application to inlet pipes associated with underground storage tanks, for example those employed to store gasoline or other liquid fuels.

BACKGROUND OF THE INVENTION

U.S. Pat. No. 5,664,951, issued Sep. 9, 1997, discloses a swivel adaptor for an inlet conduit or pipe leading to an underground storage tank for gasoline. Such underground storage tanks are typically filled from a hose associated with a tanker truck, the hose being mechanically connected to an inlet of the pipe leading to the underground tank. Connection is usually established through use of an adaptor secured to the inlet pipe and mechanically connected in some fashion to the hose.

Prior art inlet conduit adaptors of the conventional type have been plagued by the loss of sealing relationship in the interface between the hose and the inlet conduit. Gasoline and/or vapor leakage will occur at the interface when there is a sealing loss.

Sealing loss is often caused by relative rotation occurring between the various components providing the interconnection or interface. Adaptors designed for fixed attachment to the inlet pipe can have substantial torque applied thereto during the course of applying and utilizing the hose and cause the adaptor to rotate relative to the inlet conduit, in turn causing leakage.

U.S. Pat. No. 5,664,951 discloses an approach aimed at solving this problem. More particularly, a swivel adaptor is disclosed in the patent including two relatively movable components. The components are formed of electrically conductive material and are held together by an electrically conductive flexible rod located between the first and second adaptor components. The flexible rod prevents relative axial movement between the adaptor components but allows relative rotational movement therebetween in the event torque is applied to the adaptor, for example by a hose. Seals are provided between the relatively movable adaptor components to prevent or limit fluid leakage between the two adaptor components. The band employed in the arrangement of U.S. Pat. No. 5,664,951 provides an electrical connection between the first and second components for preventing the build-up of static electricity between those components.

Use of a band such as that employed in the device of U.S. Pat. No. 5,664,951 has a number of disadvantages. For example, the band can wear out and come apart over time. This not only is detrimental to the stability of the adaptor but also can result in separation of the adaptor components when substantial forces are applied thereto and band wear is significant. Furthermore, wearing of the band can impair its ability to conduct electricity between the relatively rotatable adaptor components.

DISCLOSURE OF INVENTION

The present invention relates to an improved swivel adaptor which incorporates features aimed at reducing wear of the adaptor components and also ensuring maintenance of an electrical connection between the relatively rotatable members of the swivel adaptor.

The swivel adaptor of the present invention is for connection to an inlet pipe leading to a storage tank.

The swivel adaptor includes a first swivel adaptor member for attachment to an inlet pipe leading to a storage tank, the first swivel adaptor member defining a liquid passageway. The first swivel adaptor member is electrically conductive and includes a first swivel adaptor member peripheral surface concentrically disposed about an axis and having a first swivel adaptor member ball bearing retention groove.

The adaptor also includes a second swivel adaptor member which is rotatably mounted on the first swivel adaptor member. The second swivel adaptor member has an inlet leading to the first swivel adaptor member liquid passageway. The second swivel adaptor member is also electrically conductive and includes a second swivel adaptor peripheral surface concentrically disposed about the axis adjacent to the first swivel adaptor member peripheral wall and having a second swivel adaptor member ball bearing retention groove.

The first swivel adaptor member ball bearing retention groove and the second swivel adaptor member ball bearing retention groove are in substantial registry and define a circular channel concentrically disposed about the axis.

A plurality of electrically conductive ball bearings are positioned in the channel, the ball bearings allowing ready rotation of the second swivel adaptor member relative to the first swivel adaptor member about the axis, preventing separation of the first swivel adaptor member and the second swivel adaptor member and providing an electrical interconnection between the first swivel adaptor member and the second swivel adaptor member.

Other features, advantages and objects of the present invention will become apparent with reference to the following description and accompanying drawings.

MODES FOR CARRYING OUT THE INVENTION

Figure 1:
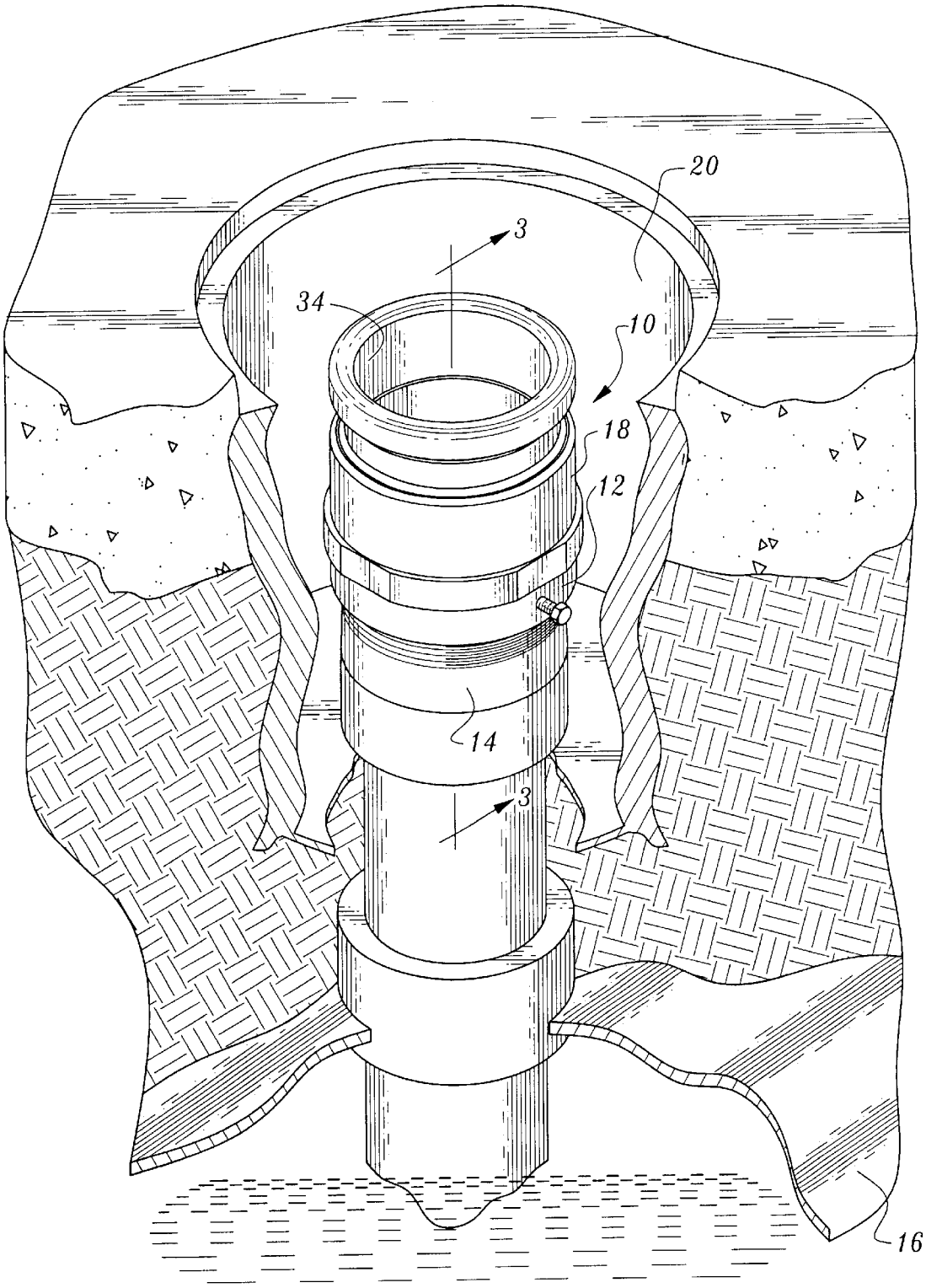
FIG. 1 is a perspective view illustrating an inlet pipe extending into the ground to an underground storage tank, a swivel adaptor constructed in accordance with the teachings of the present invention attached to the upper end of the inlet pipe.
Figure 2:
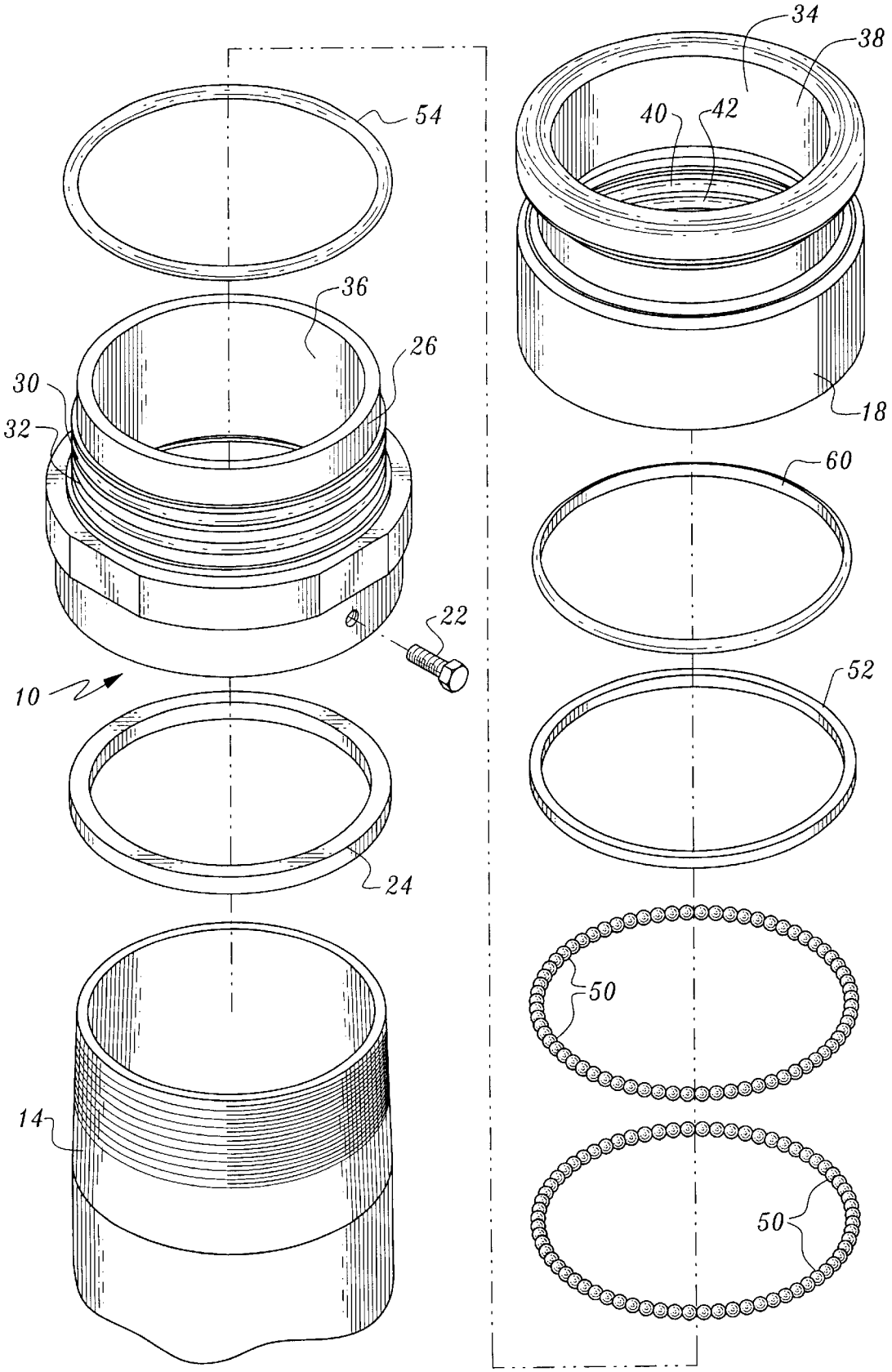
FIG. 2 is an exploded, perspective view illustrating components of the swivel adaptor.
Figure 3:
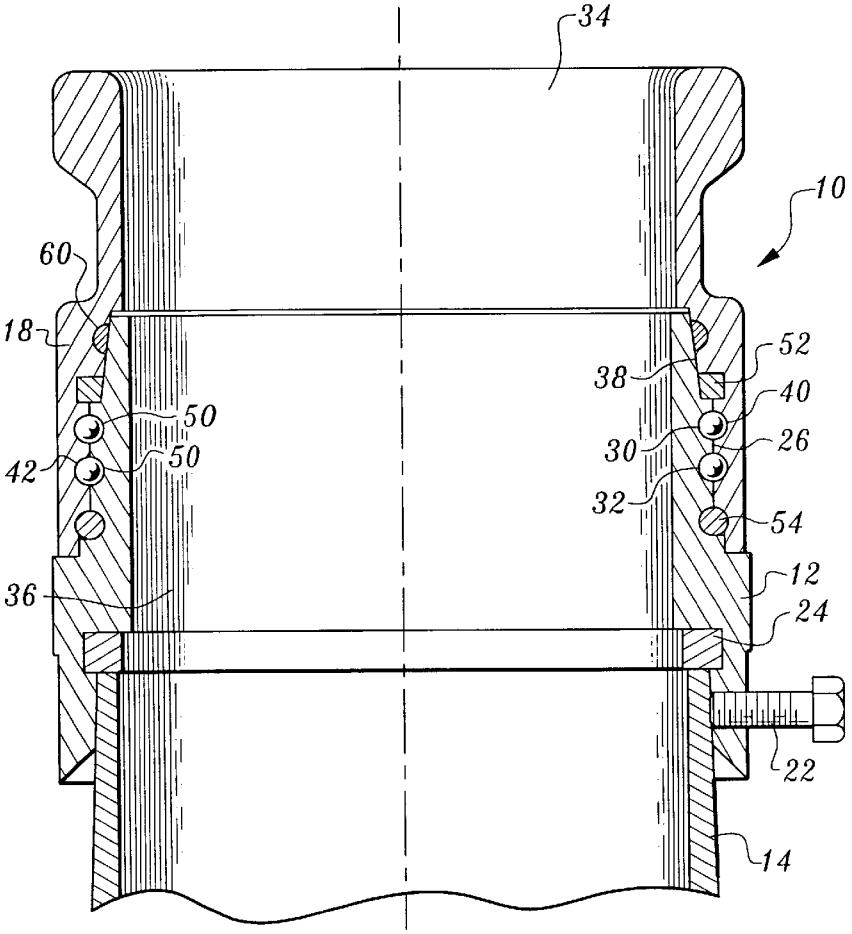
FIG. 3 is a cross-sectional, elevational view of the swivel adaptor.

Referring now to FIGS. 1–3, a swivel adaptor 10 constructed in accordance with the teachings of the present invention is illustrated. The swivel adaptor 10 includes a first swivel adaptor member 12 which, in use, is attached to an inlet pipe 14 leading to an underground gasoline storage tank 16 and a second swivel adaptor member 18 rotatably connected to the first swivel adaptor member. As is conventional, the upper end of the inlet pipe is disposed within a spill container 20.

In the arrangement illustrated, the first swivel adaptor member 12 is threadedly engaged with the inlet pipe and fixed in place by a set screw 22. A gasket 24 maintains a fluid-tight seal between the top end of the inlet pipe and the first swivel adaptor member 12.

The first swivel adaptor member 12 and the second swivel adaptor member 18 are both formed of electrically conductive material such as steel, brass or the like.

Member 12 includes a first swivel adaptor member outer peripheral surface 26 which is concentrically disposed about a central longitudinal axis. The surface 26 forms two ball bearing retention grooves 30, 32.

The second swivel adaptor member 18 is rotatably mounted on the first swivel adaptor member and has an inlet 34 leading to the first swivel adaptor member liquid passageway 36.

The adaptor member 18 includes a second swivel adaptor member inner peripheral surface 38 which is concentrically disposed about the longitudinal axis of the swivel adaptor.

The inner peripheral surface 38 forms ball bearing retention grooves 40, 42 which are in registry, respectively, with ball bearing retention grooves 30, 32 formed in the first swivel adaptor member 12. Together, the ball bearing retention grooves in registry with one another define two spaced circular channels concentrically disposed about the longitudinal axis of the adaptor.

Disposed in both of these circular channels are a plurality of electrically conductive ball bearings 50 formed of stainless steel or other suitable material. The circular channels function as ball bearing raceways, the ball bearings 50 being loosely disposed therein and directly engaging members 12, 18.

It will be appreciated that the ball bearings allow ready rotation of the second swivel adaptor member 18 relative to the first adaptor member 12 about the longitudinal axis extending through the swivel adaptor. In addition, the ball bearings 50 prevent separation of the first swivel adaptor member and the second adaptor member and provide an electrical interconnection between the first swivel adaptor member and the second swivel adaptor member. The ball bearings 50 lock the first and second swivel adaptor members together so that they cannot be pulled apart in an axial direction. Since the ball bearings rotate when member 18 rotates relative to member 12 they are subjected to a polishing action by members 12 and 18 to maintain a high quality electrical contact therebetween.

The ball bearings 50 are inserted into the channels after the first and second swivel members have been assembled and the ball bearing retention grooves placed in registry. One approach for doing this is to provide an outside opening (not shown) in second swivel adaptor member 18 communicating with the ball bearing retention grooves 40, 42 thereof. The ball bearings can be inserted through these holes into the channels formed by grooves 30, 32, 40, 42 and then the openings closed by any suitable technique such as welding, brazing or the like.

Fluid-tight seal elements 52, 54 surround first swivel adaptor member 12. The seal elements are in the form of rings which are spaced from the channels holding the ball bearings and are in engagement with both the outwardly disposed surface of the first swivel adaptor member and the inwardly disposed surface of the second swivel adaptor member 18. One of the seal elements is positioned above the channels holding the ball bearings and the other located below. Seal element 52 is in the nature of a wiper seal formed of urethane or other suitable material. Seal element 54 is preferably a Viton O-ring.

A stabilizer ring in the form of tension ring 60 is located above the channels and seal elements for resisting tilting of the second swivel adaptor member 18 relative to the first swivel adaptor member 12. Limiting or preventing tilt serves to limit build up of pressure on the seal elements and consequent wear, it being appreciated that such tilting could otherwise occur if a degree of play or looseness exists between the members 12, 18.

Stabilizer ring 60 is disposed about the upper end of the first swivel adaptor member 12, the stabilizer ring engaging both the first swivel adaptor member and the second swivel adaptor member and compressed therebetween.

It is to be noted that the outwardly disposed surface of the first swivel adaptor member 12 tapers inwardly in an upward direction at the upper end thereof. The outwardly disposed surface of the first swivel adaptor member is engaged by the stabilizer ring at the location of the taper and maintained under tension. It has been found that such an arrangement allows the degree of tensioning and placement of the tensioning ring to be adjusted for maximum effect.

Figure 4:
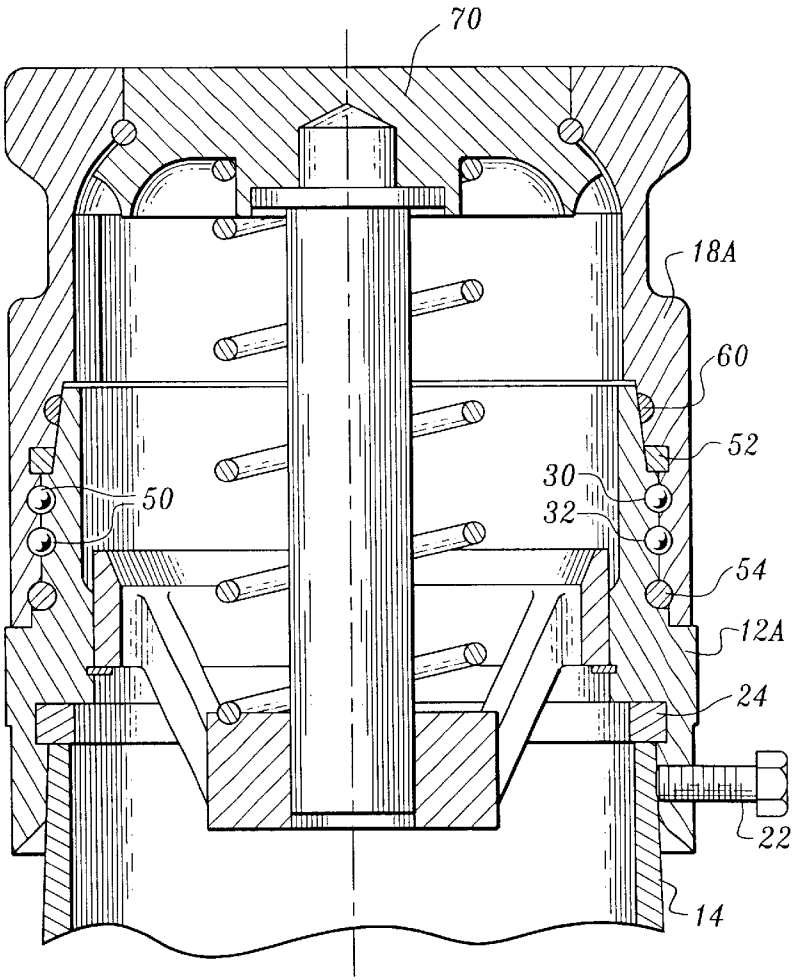
FIG. 4 is a view similar to FIG. 3, but illustrating a different embodiment of the swivel adaptor.

FIG. 4 shows another embodiment of the swivel adaptor of the present invention. In this instance the swivel adaptor member 12A and swivel adaptor member 18A house therein the components of a conventional vapor recovery arrangement including poppit 70.

The invention claimed is:

1. A swivel adaptor for connection to an inlet pipe leading to a storage tank, said swivel adaptor comprising, in combination:

a first swivel adaptor member for attachment to an inlet pipe leading to a storage tank defining a first swivel adaptor member liquid passageway, said first swivel adaptor member being electrically conductive and including a first swivel adaptor member outer peripheral surface concentrically disposed about an axis and having a pair of spaced first swivel adaptor member ball bearing retention grooves;

a second swivel adaptor member rotatably mounted on said first swivel adaptor member having an inlet leading to said first swivel adaptor member liquid passageway, said second swivel adaptor member being electrically conductive and including a second swivel adaptor member inner peripheral surface concentrically disposed about said axis adjacent to and extending around the first swivel adaptor member outer peripheral surface and having a pair of second swivel adaptor member ball bearing retention grooves, said pair of first swivel adaptor member ball bearing retention grooves and said pair of second swivel adaptor member ball bearing retention grooves being in substantial registry and defining spaced circular ball bearing raceways concentrically disposed about said axis;

a plurality of electrically conductive ball bearings positioned in said ball bearing raceways and in continuous direct contact with both said first swivel adaptor member and said second swivel adaptor member, said ball bearings allowing rotation of said second swivel adaptor member relative to said first swivel adaptor member about said axis, preventing separation of said first swivel adaptor member and said second swivel adaptor member and providing a continuous direct electrical interconnection between said first swivel adaptor member and said second swivel adaptor member;

a plurality of spaced, substantially fluid-tight seal elements surrounding the first swivel adaptor member, spaced from said ball bearing raceways and in engagement with the said first swivel adaptor member outer peripheral surface and with the second swivel adaptor member inner peripheral surface, at least one of said seal elements being disposed above said ball bearing raceways and at least one of said seal elements being disposed below said ball bearing raceways; and stabilizer means disposed above said ball bearing raceways and above said seal elements for resisting tilting of said second swivel adaptor member relative to said first swivel adaptor member to limit pressure applied to said seal elements caused by tilting movement of said second swivel adaptor member, said first swivel adaptor member having an upper end and said stabilizer means including a stabilizer ring disposed about said first swivel adaptor member at said upper end, said stabilizer ring engaging both said first swivel adaptor member and said second swivel adaptor member and compressed therebetween, the first swivel adaptor member outer peripheral surface having a tapered segment tapering inwardly in an upward direction at said upper end and the second swivel adaptor member outer peripheral surface having a tapered segment tapering outwardly in a downward direction and surrounding the tapered segment of said first swivel adaptor member outer peripheral surface, said stabilizer ring located between and engaging both tapered segments.

2. The swivel adaptor according to claim 1 wherein said stabilizer ring is maintained under tension about said first swivel adaptor member.

* * * * *